US005099672A

United States Patent [19]

Steinhauser et al.

[11] Patent Number: 5,099,672

[45] Date of Patent: Mar. 31, 1992

[54] FORMING PRESS

[75] Inventors: Ulrich Steinhauser, Allschwil; Ernst Ballmer, Basel, both of Switzerland

[73] Assignee: Hatebur Umformmaschinen AG, Reinach, Switzerland

[21] Appl. No.: 606,053

[22] Filed: Oct. 30, 1990

[30] Foreign Application Priority Data

Nov. 9, 1989 [CH] Switzerland ..... 4038/89

[51] Int. Cl.[5] ..... B21K 13/14

[52] U.S. Cl. ..... 72/345; 72/427

[58] Field of Search ..... 72/344, 345, 427

[56] References Cited

U.S. PATENT DOCUMENTS 3,524,338 8/1970 Bozek ..... 72/345
3,748,887 7/1973 Widera ..... 72/427
3,911,718 10/1975 Requarth ..... 72/344
4,222,260 9/1980 McDermott ..... 72/345

FOREIGN PATENT DOCUMENTS 1254437 5/1968 Fed. Rep. of Germany .
1527998 6/1969 Fed. Rep. of Germany .
1750033 12/1971 Fed. Rep. of Germany .
2027692 1/1974 Fed. Rep. of Germany .

*Primary Examiner*—Lowell A. Larson
*Attorney, Agent, or Firm*—Ralph W. Selitto, Jr.

[57] ABSTRACT

In the proposed forming press, a reversal device (17 to 20) is provided on a retention pin (1) inside the male die part (4) of the press, which reversal device retains the retention pin in its two end positions ($X_1$, $X_2$) until said retention pin is moved by a transmission member (10) on the male die part side or by the pressed article (2) inserted in the die (3).

14 Claims, 7 Drawing Sheets

FORMING PRESS

Figure 1:
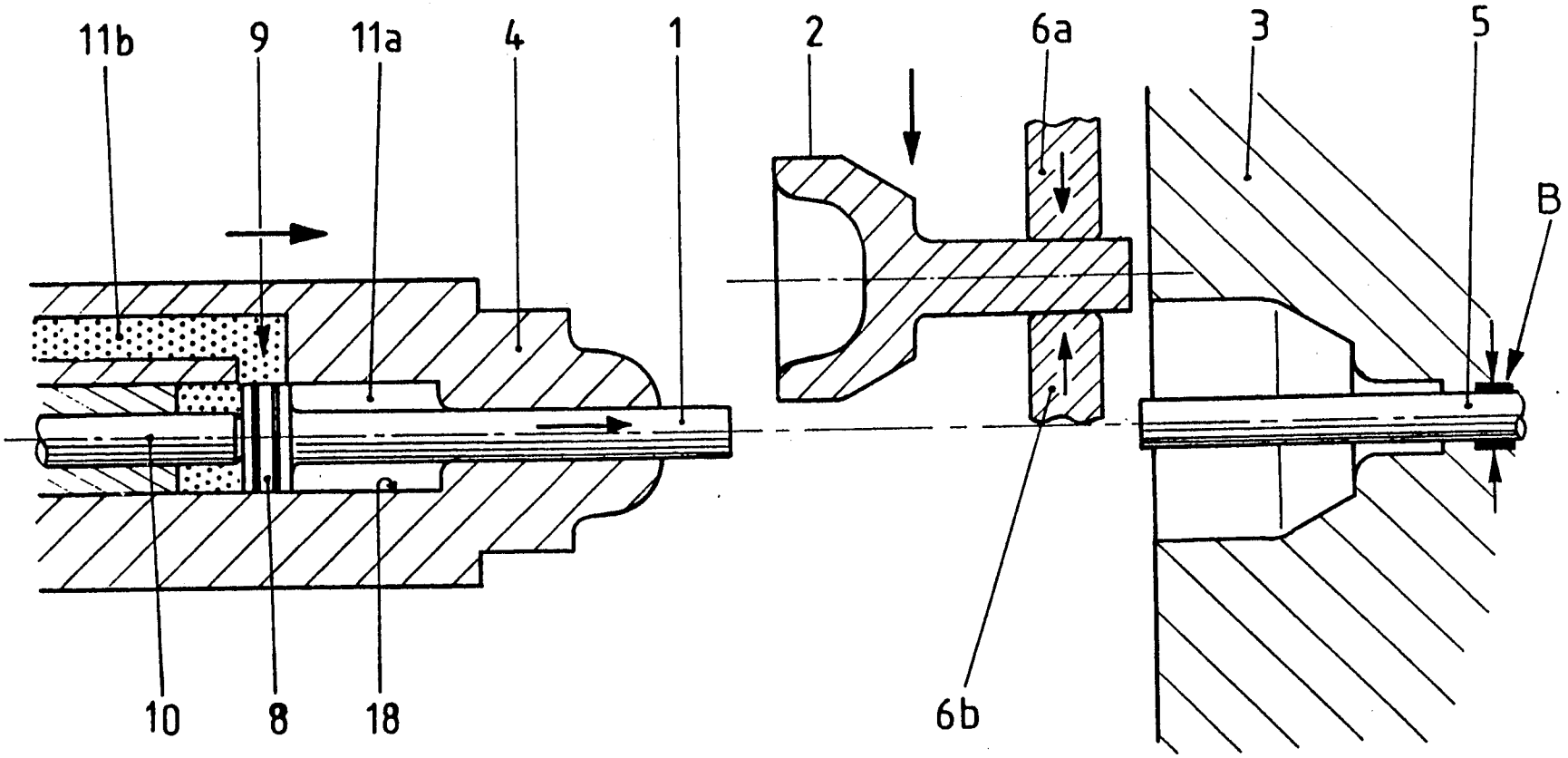

The present invention relates to a method for unloading a pressed article and to a high-speed forming press.

High-speed forming presses in the sense of the present invention are automatic cutting machines which have several forming stations arranged horizontally adjacently. In these machines, a wire, fed in stages with or without preheating, is firstly divided into portions and these are then transported with the aid of a gripper system from one forming station to another and there they are each formed between a male die part and a die until the pressed article finally falls out of the final forming station onto a conveyor belt. The high operating frequency of 50 to 180 precision pressed parts per minute, the extremely tight spatial conditions and the range of part shapes to be produced as well as the easy accessibility and exchangeability of the forming tools thus required place great demands on the design of the individual units and their functional interaction.

In view of the desired operating frequency mentioned, it has proved to be particularly difficult to eject pressed parts, which have a hollow shape open towards the male die part, out of the final forming stage in a fault-free manner. It is known that, after the pressed article has left the penultimate forming station, it is placed in front of the final forming die by a pair of grippers and held there against the ejector by a retention pin mounted in the male die part and pushed into the die, after which the forming takes place. After the forming, however, the retention pin, prestressed resiliently in the direction of the die, should disappear from the ejection region as rapidly as possible, which has not been possible, however, for the high operating frequency of about 50 to 180 items per minute using the means known hitherto. At these high production rates, the pressed article remains attached to the retention pin still projecting partially into its hollow shape, which can result in severe damage to the machine and to interruptions in production.

Devices for ejector control or for movement transition are described in German Patent Publication Nos. 1,254,437 and 1,750,033.

It has already been attempted to move the retention pin mounted movably in the male die part back and forth pneumatically or hydraulically and to control the sequence of movement by a valve. However, this did not prove to be implementable since, in view of the extremely short switching times, the valve has to be arranged on the press slide, but there it is then subjected to unavoidable vibrations and is consequently no longer able to fulfil the demands for precision placed on it.

DE-AS 2,027,692 shows a conventional ejector without automatic control, in which case pressed parts, such as joint crosses, tripods, T-pieces, etc., are guided or held between the forming tools by ejectors on the die side and retention pins on the male die part side. In contrast to this, according to the present invention, a retention pin is retracted into the male die part by automatic control during the withdrawal of the male die part. By virtue of this development, parts having a deep pressing shape on the male die part side, so-called "tulips", can fall down into the discharge chute in an unimpeded manner.

U.S. Pat. No. 3,911,718 shows, inter alia, a retention pin/piston combination (part 35*a*, FIGS. 5 and 6), by means of which controlled withdrawal would be possible. However, the control required for this takes place via valves arranged away from the tool with the result that a proposal of this type cannot lead to the desired success due to the inevitably entailed switching time delays in high-speed forming presses.

The apparatus illustrated in U.S. Pat. No. 3,748,887 also shows retention pins which are controlled by pneumatic valves arranged away from the forming tool. In view of the relatively long connection lines between the valve and the operating cylinder, such long switching times also result in this case that this control cannot be used in high-speed forming machines.

Thus, the object underlying the present invention was to develop a control for the retention pin on the male die part side whilst avoiding additional switching and control members, that is to say using the elements already present on the machine in the tool region, which control functions virtually independently of vibrations even at extreme ejection frequencies and completely synchronously in relation to the main drive of the machine and, at the same time, is easily accessible in an uncomplicated construction and is thus rapidly exchangeable. Accordingly, the intention is for the retention pin on the male die part side to receive the preformed pressed article from the penultimate forming station in the course of a press slide stroke, to push it into the die and to withdraw it together with the returning male die part after the forming has taken place in order no longer to be in the way of the pressed article which is ejected from the die and then falls down due to the effect of gravity.

This object is achieved by the present invention which is further defined in the preferred embodiments of the concept of the invention.

Figure 2:
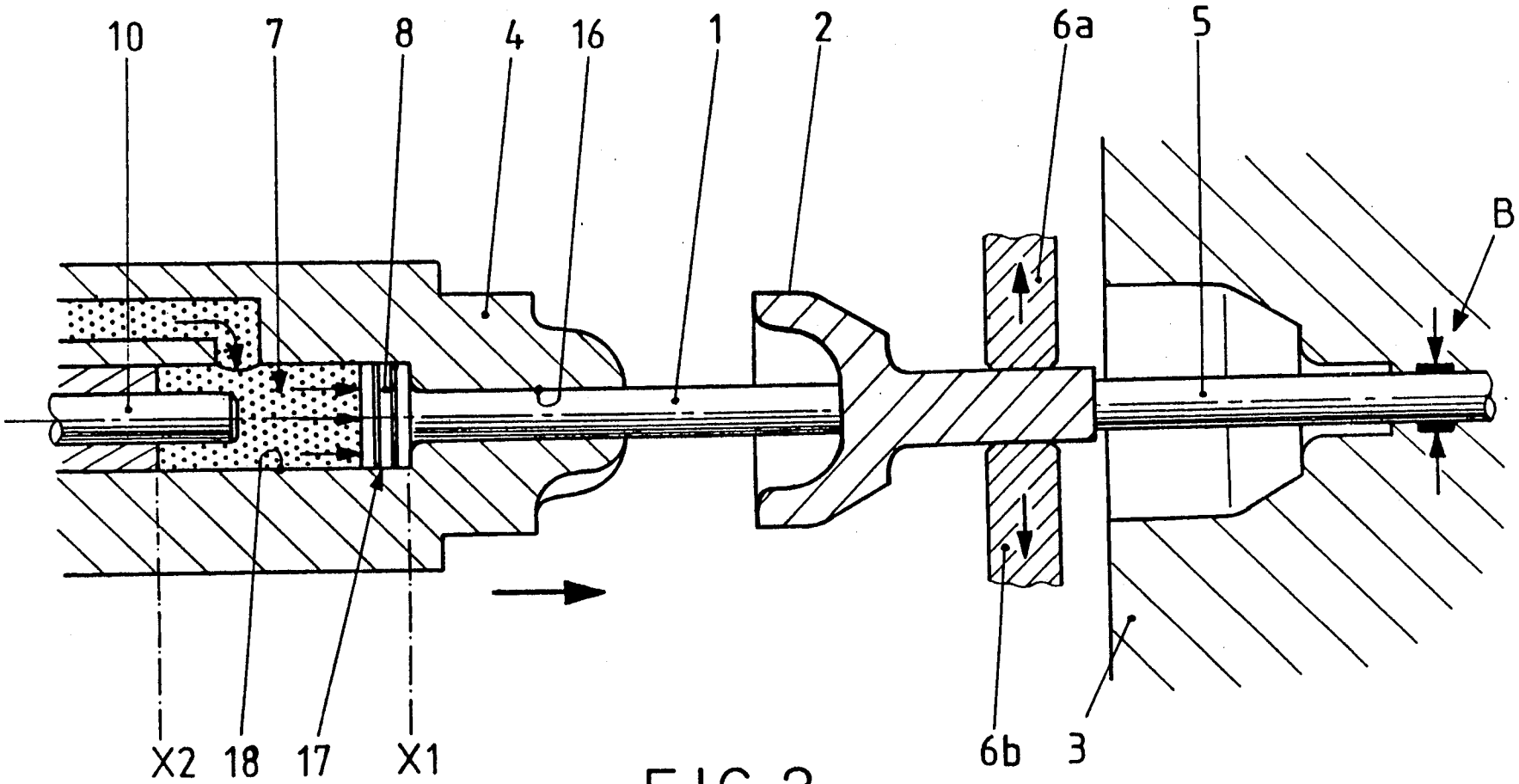

Exemplary embodiments of the crossbelt press according to the invention are described below with reference to the attached drawings, in which:

FIG. 1 shows a diagrammatic sectional lateral view of a first embodiment of a forming press having the features of the invention at a point in time in the function, at which a pressed article, held by press tongs, is about to reach a forming stage, FIG. 2 shows a diagrammatic lateral view of the embodiment according to FIG. 1 at a point in time in the function, at which the pressed article has reached the forming stage and is held there between the retention pin and the ejector.

Figure 3:
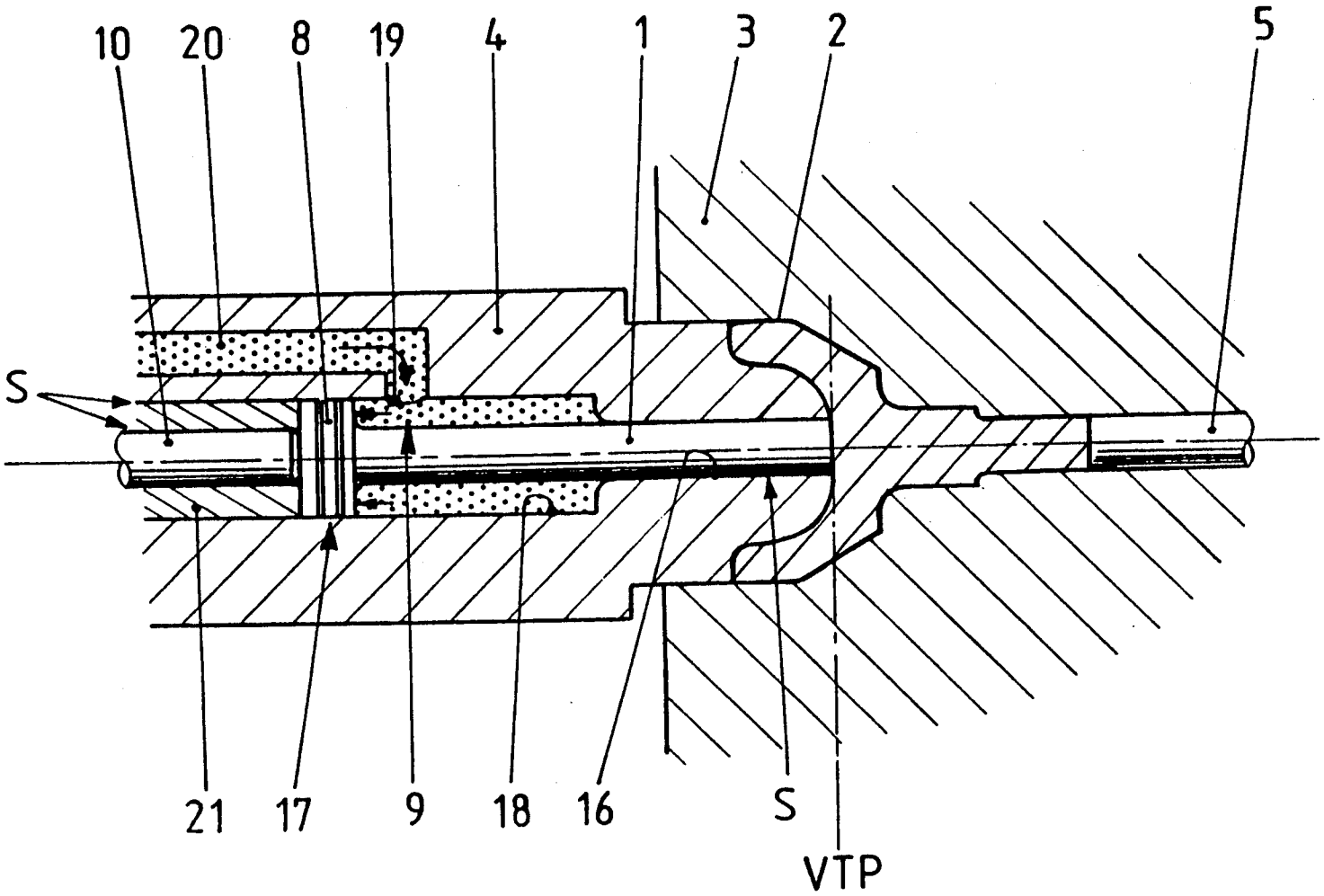
Figure 4:
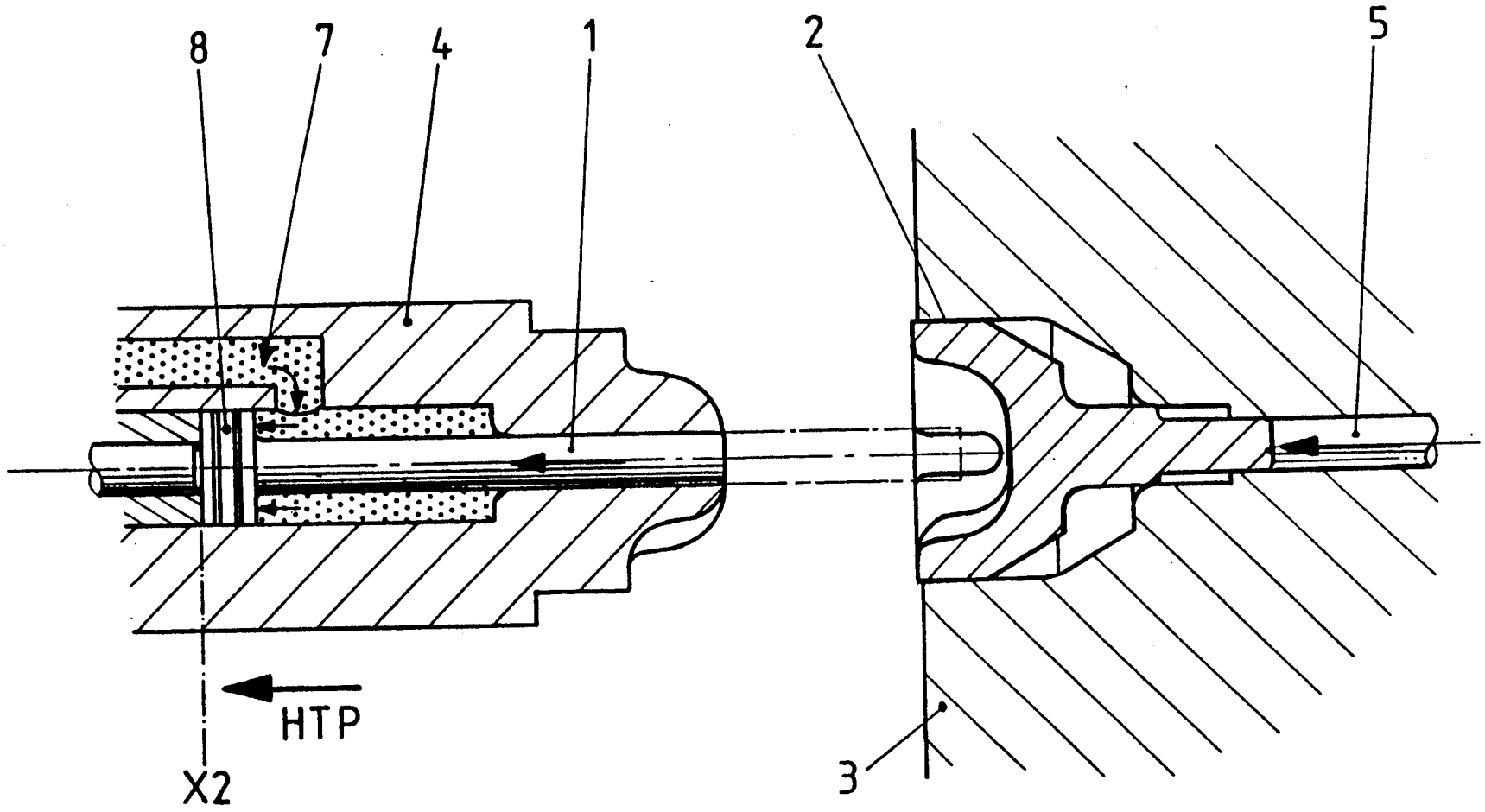
Figure 5:
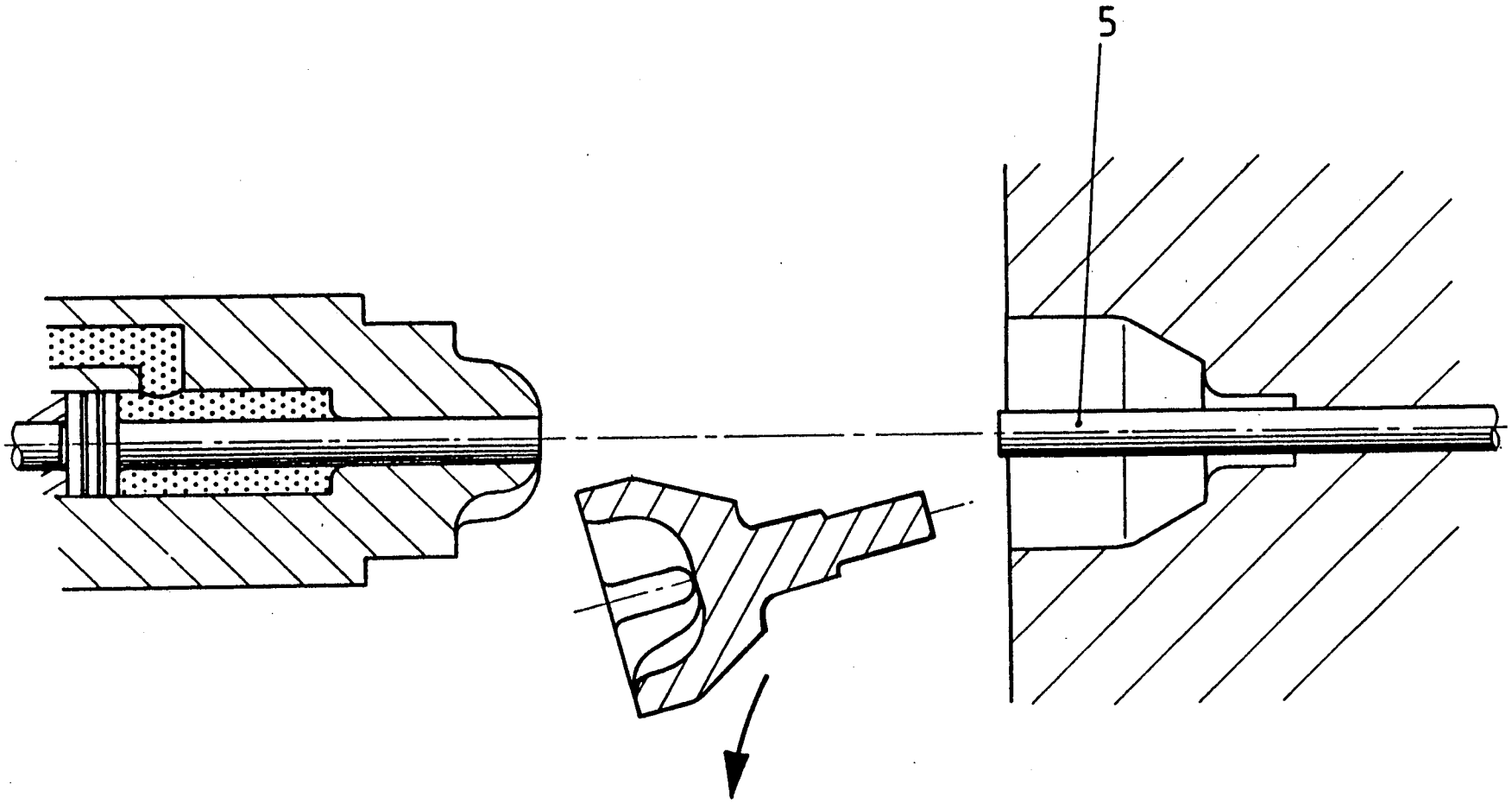
Figure 6:
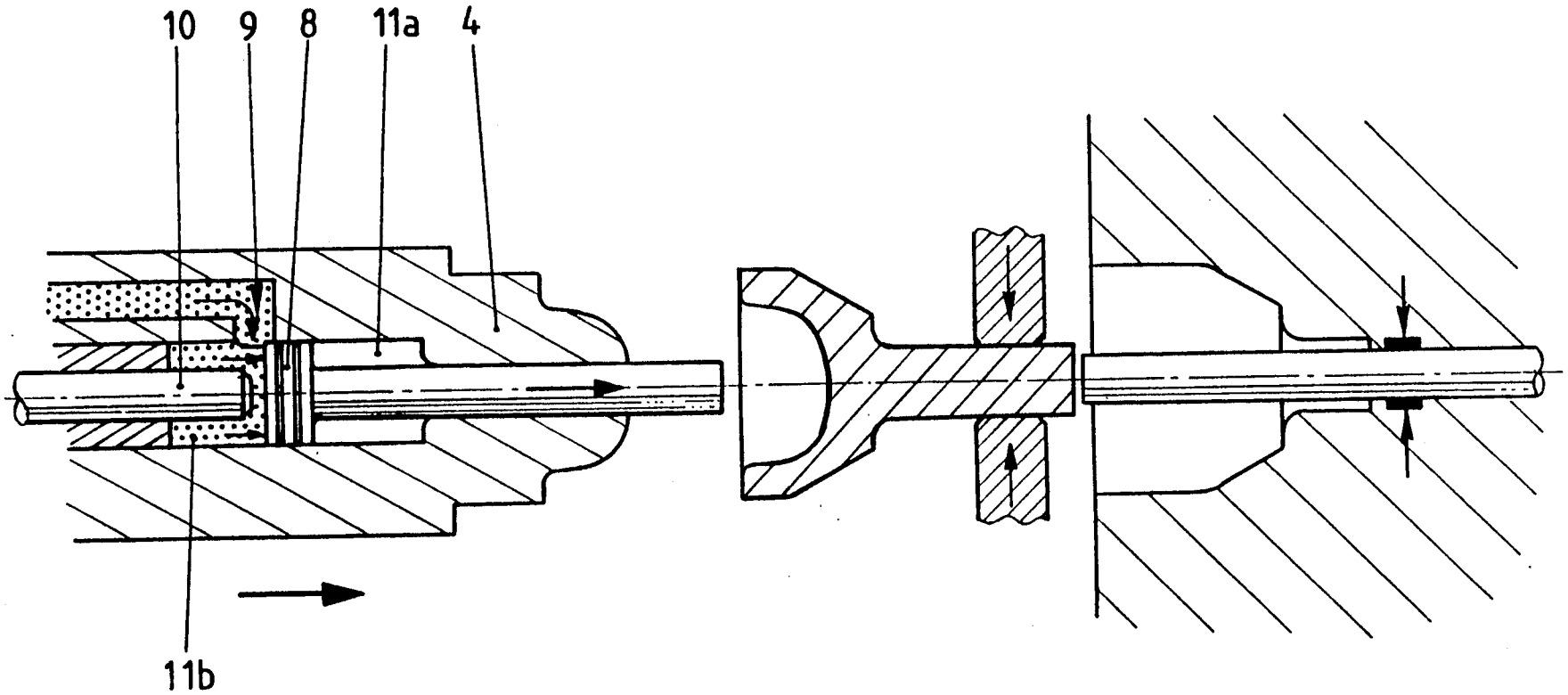
Figure 7A:
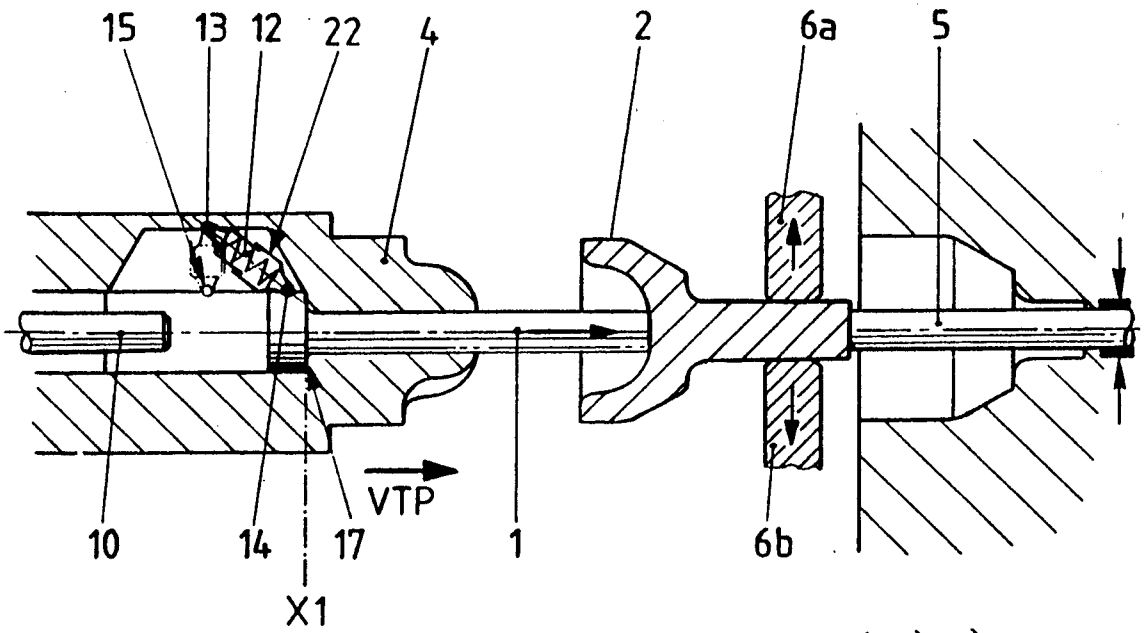
Figure 7B:
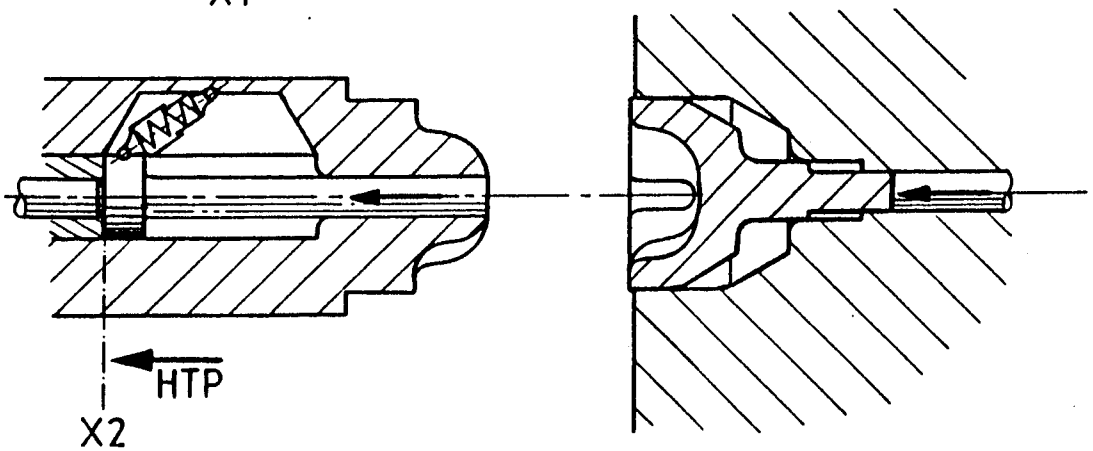

FIG. 3 shows a diagrammatic lateral view of the embodiment according to FIG. 1 at a point in time in the function, at which the male die part is at the front dead center (FDC) of its stroke, FIG. 4 shows a diagrammatic lateral view of the embodiment according to FIG. 1 at a point in time in the function, at which the male die part is on the way to the rear dead center (RDC) of its stroke, FIG. 5 shows a diagrammatic lateral view of the embodiment according to FIG. 1 at a point in time in the function, at which the pressed article is ejected from the die and falls down, FIG. 6 shows a diagrammatic lateral view of the embodiment according to FIG. 1 at a point in time in the function, at which a new pressed article has been transported in front of the forming station and is about to be held between the retention pin and the ejector, and FIGS. 7*a* and 7*b* show a second embodiment of a forming press having the features according to the invention with a modified device for the retention pin reversal.

In FIG. 1, a pressed part or pressed article 2 on a horizontally operating multi-stage press is fed laterally to the illustrated forming station in the direction of the arrow pointing from the top downwards in the illustration. In this process, the pressed article 2 is placed in its forming position by a pair of transverse transport tongs having tong jaws 6*a*, 6*b* and then held between an ejector 5 and a retention pin 1 during the thrusting by and into the tools (die 3 and male die part 4) (FIG. 2) so that the tong jaws 6*a*, 6*b* can be released from the pressed article again. The ejector 5 is braked in its longitudinal movement by a known ejector brake B.

The retention pin 1 is a controlled retention pin since it can be displaced via an ejector pin 10 which is coupled with a known ejector drive and is guided in a bearing bush 21 preferably coaxially inside the male die part 4. The control via the ejector pin 10 on the male die part side causes the pressed article 2, as illustrated in FIG. 2, to be forced against the braked ejector 5 prior to commencement of the thrusting by the male die part 4 into the die 3 so that the male die part 4 can then carry out its forming work as is visible in FIG. 3.

The retention pin 1 is guided displaceably on its portion facing the head of the male die part in a preferably coaxial bore hole 16 of the male die part and it has on its end portion 17 facing away from the head of the male die part a piston 8 which can be displaced, together with the retention pin 1, between a front end position $X_1$ and a rear end position $X_2$ in a coaxial bore hole 18 which is extended in relation to the bore hole of the male die part. A line 20, with its opening 19 at a pressure medium inlet point 9 located along the displacement path, feeds a pressure medium 7 from a source (not illustrated) into the coaxial bore hole 18. Whenever the piston 8 has been moved by the ejector pin 10 on the male die part side into a position shortly after the reversal point 9, as is visible in FIG. 1, the pressure medium 7 flows from the line 20 into the cylinder space portion 11*b* and pushes the retention pin 1 at a high speed at the corresponding pressure into its position illustrated in FIG. 2, in which it is at the front end position $X_1$ and, at the same time, forces the pressed article 2 against the braked ejector 5.

On subsequent movement of the male die part into the position illustrated in FIG. 3, the retention pin 1, supported on the pressed article 2, is pushed back into the bore hole 18 and the piston 8 is again forced back over the reversal point 9 until it strikes its rear end position $X_2$. As soon as the piston passes the reversal point 9, pressure medium 7 flows out of the line 20 into the now exposed cylinder space portion 11*a*, which pressure medium acts on the corresponding piston ring surface and presses the piston 8 onto the rear end position and retains it there.

On the return movement of the male die part 4 illustrated in FIG. 4, the retention pin 1, retained in the male die part by the pressure medium 7, is thus moved out of the die 3. Illustrated by dot-dashed lines in FIG. 4 is the position in which the retention pin 1 would be if it were not withdrawn into the die 4 as described above. It is deducible from this illustration that a retention pin projecting in this manner into the hollow space of a pressed article 2 would impede rapid ejection of the pressed article from the die and not readily permit a free downward fall, as shown in FIG. 5.

The pressure medium compressed in the respective cylinder space portions 11*a* and 11*b* when the piston 8 moves past the reversal point 9 can escape through the tolerance clearances S, indicated in FIG. 3, in the guides of the retention pin 1 and the bearing bush 21 of the ejector pin 10 on the male die part side. If required, however, deaeration channels could also be provided on the male die part side.

In the modified embodiment according to FIGS. 7*a* and 7*b*, the device described above operating with a pressure medium reversal is replaced by a fly spring apparatus. A fly spring 12, guided as a compression spring in a telescopic housing 22, is attached between a bearing 13 inside the male die part 4 and a bearing 14 on the retention pin 1 or on its end portion 17. Whenever the retention pin 1 is moved longitudinally by the transmission member 10 or the advance of the male die part 4, as in the embodiment described above, the fly spring 12 passes through a spring turning point 15 (FIG. 7*a*) and charges the retention pin on both sides of this turning point in the direction of the front or rear end position $X_1$, $X_2$. In the illustration in FIG. 7*a*, the retention pin is in its front end position $X_1$, in the illustration in FIG. 7*b* in its rear end position $X_2$.

Both in the first embodiment controlled via the pressure medium 7 and in the fly spring apparatus, it is favorable to provide the reversal point 9 or the spring turning point 15 at different positions along the movement path of the retention pin 1 for different pressing operations.

In order to be able to undertake easy and rapid changeover of the tool on the male die part side, provision is made according to a further embodiment (not illustrated) to make the retention pin reversal controls available as a construction unit, in each case with line openings 19 arranged at different longitudinal intervals between the end positions $X_1$ and $X_2$ or with differently placed fly spring turning points 15.

According to a further embodiment (likewise not illustrated), the retention pin 1 could also be moved on its piston 8 via directional control valves forwards and rearwards relative to the male die part 4. This embodiment variant is suitable, in particular, for comparatively slow-running presses, in which the reversal operation does not require an extremely high reversal rate. In this case, the directional control valves on the male die part side should be mounted as near as possible to the piston 8.

The first and second embodiments can be used on forming presses having high numbers of pressing strokes with up to over 180 strokes per minute. In this case, the actual reversal operation of the retention pin takes up only a small fraction of the number of pressing strokes, which can be reliably implemented with these embodiments.

In addition to the advantages already mentioned, it should be added that the reversal effected according to the invention in conjunction with the actuation of the ejector pin on the male die part side guarantees a switching frequency in short-term and in permanent operation which is precisely coordinated with the respectively required production rate. Furthermore, the control device accommodated in the male die part, for example as an exchangeable construction element, is completely protected against external influences and can be assembled and dismantled rapidly and easily on the male die part side.

The overall simple concept and the robust construction of the reversal device according to the invention finally also allows simple refitting of existing tools.

We claim:

1. In a forming press or the like having a die and a punch coaxially mounted for reciprocating movement with respect to said die, said punch having a forming surface facing said die, a cylinder positioned substantially coaxially within said punch and having a front wall and a back wall; a retention pin mounted for reciprocating movement with respect to said punch such that said retention pin moves through said front wall of said cylinder as said punch moves toward said die, said retention pin including a first end, having a guide surface for guiding an article to be pressed into said die during a forming operation, and a second end, having a piston provided with a front surface and a back surface, said piston being positioned within said cylinder for reciprocating movement between a retracted position, in which said back surface of said piston abuts said back wall of said cylinder, and an extended position, in which said front surface of said piston abuts said front wall of said cylinder, and being movable back and forth past an intermediate position, located between said retracted and extended positions, as said piston moves from said retracted position to said extended position and vice versa; and an ejection pin for moving said piston from said retracted position beyond said intermediate position, the improvement comprising: urging means positioned in said punch for urging said piston toward said retracted position or said extended position depending upon the position of said piston with respect to said intermediate position, said urging means operating to urge said piston toward said extended position after, but only after, said piston has been moved from said retracted position beyond said intermediate position by said ejection pin, and to urge said piston toward said retracted position after, but only after, said piston has been moved from said extended position beyond said intermediate position in response to the engagement of said guide surface of said retention pin by an article to be pressed into said die during a forming operation.

2. The improved forming press according to claim 1, wherein said urging means retains said piston in said retracted position until said piston is moved by said ejection pin, and wherein said urging means retains said piston in said extended position until said piston is moved in response to the engagement of said guide surface of said retention pin by an article to be pressed into said die during a forming operation.

3. The improved forming press according to claim 1, wherein said urging means includes an opening, which communicates with said cylinder between said front and back walls thereof, and supplying means for supplying pressurized fluid to said cylinder through said opening such that pressurized fluid is supplied to a portion of said cylinder delimited by said back wall of said cylinder and said back surface of said piston, when said piston has been moved from said retracted position beyond said intermediate position, and such that pressurized fluid is supplied to another portion of said cylinder delimited by said front wall of said cylinder and said front surface of said piston, when said piston has been moved from said extended position beyond said intermediate position.

4. The improved forming press according to claim 3, wherein said supplying means continuously supplies pressurized fluid to said cylinder through said opening.

5. The improved forming press according to claim 1, wherein said punch includes a bearing bush in which said ejection pin is guided, said bearing bush and said cylinder each being provided with a tolerance clearance sufficient to permit pressurized fluid to flow therethrough as said piston reciprocates within said cylinder between said retracted and extended positions.

6. The improved forming press according to claim 1, wherein said urging means includes a fly spring having a first end attached to said piston and a second end pivotally attached to an interior surface of said punch, said fly spring having a turning point which corresponds to said intermediate position, whereby said first end of said fly spring is on one side of said turning point when said piston has been moved from said retracted position beyond said intermediate position by said ejection pin, and said first end of said fly spring is on an opposite side of said turning point when said piston has been moved from said extended position beyond said intermediate position in response to the engagement of said guide surface of said retention pin by an article to be pressed into said die during a forming operation.

7. The improved punch according to claim 6, wherein said fly spring is a compression spring mounted in a telescopic housing.

8. A method for moving a retention pin mounted in a punch facing a die of a forming press or the like, said punch being coaxially mounted for reciprocating movement with respect to said die and having a cylinder positioned substantially coaxially therein with a front wall and a back wall, and said retention pin being mounted for reciprocating movement with respect to said punch such that said retention pin moves through said front wall of said cylinder as said punch moves toward said die, said retention pin including a first end, having a guide surface for guiding an article to be pressed into said die during a forming operation, and a second end, having a piston provided with a front surface and a back surface, said piston being positioned within said cylinder for reciprocating movement between a retracted position, in which said back surface of said piston abuts said back wall of said cylinder, and an extended position, in which said front surface of said piston abuts said front wall of said cylinder, the method comprising the step of urging said piston to said retracted position or said extended position depending upon the position of said piston with respect to an intermediate position, which is located between said retracted and extended positions.

9. The method according to claim 8, further comprising the steps of: moving said retention pin from said retracted position beyond said intermediate position in response to the engagement of said piston by an ejection pin mounted for reciprocating movement through said back wall of said cylinder; urging said retention pin to said extended position after, but only after, said retention pin has been moved from said retracted position beyond said intermediate position; moving said retention pin from said extended position beyond said intermediate position in response to the engagement of said guide surface of said retention pin by an article to be pressed into said die during a forming operation; and urging said retention pin to said retracted position after, but only after, said retention pin has been moved from said extended position beyond said intermediate position.

10. The method according to claim 9, wherein said piston is retained in said retracted position until said piston is moved by said ejection pin, and wherein said piston is retained in said extended position until said piston is moved in response to the engagement of said guide surface of said retention pin by an article to be pressed into said die during a forming operation.

11. The method according to claim 9, wherein pressurized fluid is used for urging said piston to said retracted and extended positions, said pressurized fluid being supplied to said cylinder through an opening located relative to said intermediate position such that, when said piston has been moved from said retracted position beyond said intermediate position, pressurized fluid is supplied to a portion of said cylinder delimited by said back wall of said cylinder and said back surface of said piston, thereby urging said piston to said extended position, and such that, when said piston has been moved from said extended position beyond said intermediate position, pressurized fluid is supplied to another portion of said cylinder delimited by said front wall of said cylinder and said front surface of said piston, thereby urging said piston to said retracted position.

12. The method according to claim 11, wherein pressurized fluid is continuously supplied to said cylinder through said opening.

13. The method according to claim 8, wherein a fly spring is used for urging said piston to said retracted and extended positions, said fly spring having a first end attached to said piston, a second end pivotally attached to an interior surface of said punch, and a turning point which corresponds to said intermediate position, whereby said first end of said fly spring is urged to said extended position on one side of said turning point when said piston has been moved from said retracted position beyond said intermediate position by said ejection pin and said first end of said fly spring is urged to said retracted position on an opposite side of said turning point when said piston has been moved from said extended position beyond said intermediate position in response to the engagement of said guide surface of said retention pin by an article to be pressed into said die during a forming operation.

14. The method according to claim 13, wherein said fly spring is a compression spring mounted in a telescopic housing.

* * * * *